US008398338B2

(12) United States Patent
Rystedt et al.

(10) Patent No.: US 8,398,338 B2
(45) Date of Patent: Mar. 19, 2013

(54) METHOD FOR INSTALLING A TOPSIDE MODULE ON AN OFFSHORE SUPPORT STRUCTURE

(75) Inventors: Jan Rystedt, Göteborg (SE); Peter Ankarswärd, Västra Frölunda (SE)

(73) Assignee: GVA Consultants AB, Gothenburg (SE)

( * ) Notice: Subject to any disclaimer, the term of this patent is extended or adjusted under 35 U.S.C. 154(b) by 349 days.

(21) Appl. No.: 12/782,764

(22) Filed: May 19, 2010

(65) Prior Publication Data

US 2010/0296873 A1 Nov. 25, 2010

Related U.S. Application Data

(60) Provisional application No. 61/179,399, filed on May 19, 2009.

(30) Foreign Application Priority Data

May 19, 2009 (SE) ..... 0950357

(51) Int. Cl.
*E02B 17/08* (2006.01)

(52) U.S. Cl. ..... 405/205; 405/204; 405/209

(58) Field of Classification Search ..... 405/204, 405/205, 200, 203, 206, 209
See application file for complete search history.

(56) References Cited

U.S. PATENT DOCUMENTS

| | | | | |
|---|---|---|---|---|
| 5,219,451 | A | 6/1993 | Datta et al. | |
| 5,522,680 | A | 6/1996 | Hoss et al. | |
| 6,293,734 | B1 | 9/2001 | Thomas et al. | |
| 2004/0159276 | A1 * | 8/2004 | Persson | 114/264 |
| 2004/0218983 | A1 | 11/2004 | Roraas et al. | |

FOREIGN PATENT DOCUMENTS

| | | |
|---|---|---|
| GB | 2022662 | 12/1979 |
| KR | 10-2002-0085334 | * 11/2002 |

* cited by examiner

*Primary Examiner* — David Bagnell
*Assistant Examiner* — Carib Oquendo
(74) *Attorney, Agent, or Firm* — KBR IP Legal Dept

(57) ABSTRACT

Method for installing a topside module on an offshore support structure that in use comprises at least one support leg that extends a height above the water level. The method comprises the steps of supporting said topside module on a barge in a position adjacent to said at least one support leg and de-ballasting the barge to lift the topside module a height above water level.

2 Claims, 14 Drawing Sheets

METHOD FOR INSTALLING A TOPSIDE MODULE ON AN OFFSHORE SUPPORT STRUCTURE

CROSS-REFERENCE TO RELATED APPLICATIONS

This application claims benefit of U.S. Provisional Patent Application No. 61/179,399, filed on May 19, 2009, and of Swedish Patent Application 0950357-4 filed on May 19, 2009.

BACKGROUND

1. Field

The present invention concerns a method for installing a topside module on an offshore support structure that comprises at least one support leg that extends a vertical height above the water level when in use.

2. Background of the Invention

An offshore installation, such as a power plant or an oil rig, is a large structure used to house workers and/or machinery needed to drill wells in the sea floor, extract oil and/or natural gas, process the produced fluids and/or to convert renewable energy, such as wind, wave or water current energy, into a useful form, such as electricity. Moreover, the offshore installation may comprise equipment for converting electric power, e.g. from alternating current to direct current before it is conveyed to land. The offshore installation may be attached to the sea floor or an artificial island or be floating.

The deck of an offshore installation is conventionally installed on a support structure, sometimes called a "jacket structure". The support structure may be entirely or partially immersed in water. The support structure usually includes a number of vertical or substantially vertical tubular members which constitute support legs for the deck. The deck and the support structure of an offshore installation are usually prefabricated separately on land or in a dry dock and they are then transported to a site at sea where they are subsequently assembled.

Given the large size and mass of the components of an offshore installation (where a deck alone can weigh several thousands or several tens of thousands of tons), installing the deck and other components of an offshore installation on a support structure that extends a height above the water level, has conventionally involved the use of expensive equipment, such as semi-submersible crane vessels or winching means, and is a costly, labour-intensive and complex procedure.

European patent application no. EP 654564 discloses a method for installing the deck of an off-shore platform on the support members of the support legs of a support structure. The ballastable barge, which supports the deck at a height above the support members, is brought into a position between the support legs of the support structure. The barge is then positioned so that the deck can be lowered into alignment with its corresponding support members. The barge is then ballasted to transfer the weight of the deck to the support structure. Such a method is however not suitable for installing the deck of an offshore installation on a support structure that extends a height above the water level, which height is greater than the height at which a barge can support the deck in a stable manner.

SUMMARY OF THE INVENTION

An object of the invention is to overcome or ameliorate at least one of the disadvantages of the prior art, or to provide a useful alternative. A further object of the present invention is to provide a method for installing a topside module on an offshore support structure that, in use, comprises at least one support leg that extends a height above the water level.

At least one of the objects is achieved by a method that comprises the steps of supporting the topside module on a barge in a position adjacent to the at least one support leg and de-ballasting the barge to lift the topside module to a height above water level.

The expression "in a position adjacent to the at least one support leg" is intended to mean that a part of the topside module and/or a part of the barge in contact with one of the at least one support legs or that a part of the topside module and/or a part of the barge is within the proximity of the support leg, preferably within a horizontal distance of 50 cm, preferably within 30 cm or less of at least one of the at least one support legs. By the term "horizontal" is meant substantially parallel with the still water level. So that the topside module and/or barge are substantially prevented from moving more that a predetermined horizontal distance from the at least one support leg by the at least one support leg during the lifting of the topside module.

The expression "a part of the topside module and/or a part of the barge" is intended to mean that a constituent part of the topside module and/or barge, or a part that is attached thereto, is placed adjacent to at least one support leg or is placed in a position in which it may or will make contact with the at least one support leg (substantially continuously or intermittently) during the de-ballasting of the barge. It should also be noted that a part of a topside module and/or a part of a barge need not necessarily be adjacent to a vertically extending support leg (i.e. vertical with respect to the water level), but can be arranged to be adjacent to a diagonally extending support leg or with a support leg comprising a plurality of horizontally and/or diagonally extending parts, as long as the topside module and/or barge are in some way adapted to be supported or hindered from moving more that a predetermined horizontal distance away from at least one support leg during the lifting of the topside module.

Since a part of the topside module and/or a part of the barge is positioned adjacent to at least one support leg of the support structure, the at least one support leg will support the topside module and/or barge and keep them stable as the topside module is lifted. Topside modules having a high centre of gravity may therefore be safely lifted using such a method, even though lifting a topside module using a floating barge might not be sufficiently stable per se.

The height above the water level at which a topside module may be supported by a ballasted barge in a stable manner is namely increased simply by de-ballasting the barge, which allows a topside module to be raised and installed on a support structure having support legs that extend a height greater than the height at which the barge can support the topside module above the water level in a stable manner. Such a method may therefore be used to efficiently and simply install a topside module on a support structure without needing to utilize a semi-submersible crane vessel or other lifting device.

The expression "barge" as used in this document is intended to mean any ballastable floating, submersible or semi-submersible self-driven or non-self-driven vehicle or platform capable of supporting and, optionally transporting, a topside module of an offshore installation in water.

The expression "topside module" as used in this document is intended to mean any component, or component part of an offshore installation that is, in use, arranged to at least partly extend above water level. It may for example constitute part of a deck of an offshore installation or equipment that is arranged on the deck of the offshore installation.

It should be noted that the expression "in use" is intended to mean that a topside module may be installed on the support legs of a support structure while the support legs are submerged at, or below water level and then both the support structure and the topside module may be lifted using a method according to an embodiment of the invention.

According to an embodiment of the invention the method also comprises the steps of ballasting the barge to increase the draught of the barge, or optionally to submerge the barge, after the topside module has been positioned adjacent to at least one of the support legs of a support structure. The method comprises the step of providing vertical spacer means between the submerged barge and the topside module (i.e. spacer means to maintain a vertical distance between the submerged barge and the topside module, whereby said vertical distance need not necessarily correspond to distance by which the barge is submerged), and subsequently de-ballasting the barge to lift the topside module and the spacer means to a height above water level. In this embodiment, at least a part of the spacer means may be positioned adjacent to the at least one support leg instead of or in addition to a part of the topside module and/or a part of the barge being positioned adjacent thereto, whereby a part of the spacer means is adapted to be in contact with at least one support leg or to remain within a predetermined horizontal distance of the at least one support leg.

The topside module may be temporarily anchored to the at least one support leg to prevent it from moving vertically before the barge is submerged and subsequently disconnected from the at least one support leg when the barge is de-ballasted. Alternatively, a ballastable topside module may be arranged to be ballasted at a different rate to the barge in order to create a vertical space between the submerged barge and the topside module, in which space spacer means may be provided. Optionally, the topside module may be buoyant (not necessarily ballastable) so that the topside module will float at a predetermined draught when the barge is submerged.

The spacer means may comprise a plurality of stanchions that is connected between the barge and the topside module or a substantially non-compressible ballastable block that is positioned between the submerged barge and the topside module.

The spacer means may be arranged to be fixedly attached to the barge and releasably attached to the topside module during the installation of the topside module, and may comprise locking means to lock the barge at a predetermined distance below the topside module when the barge has been submerged a desired distance below water level.

Alternatively, the spacer means may be arranged to be fixedly attached to the topside module and releasably attached to the barge during the installation of the topside module and may comprise locking means to lock the topside module at a predetermined distance from the barge when the barge has been submerged a desired distance below water level. It should however be noted that the spacer means may comprise a combination of different spacer means.

The locking of the spacing means may be carried out manually, using mechanical means for example, or automatically, using a programmable controller for example.

The spacer means may be disconnected from the topside module or removed from between the barge and the topside module once the topside module has been installed on the support structure.

According to another embodiment of the invention the offshore support structure comprises a plurality of the support legs and the method comprises the step of supporting the topside module on a barge in a position in between the plurality of support legs, whereby at least a part of the topside module or a plurality of parts of the topside module is/are placed adjacent to the plurality of support legs. It should be noted that a single support leg may be sufficient to provide the required support or horizontal movement prevention in certain installations especially if the wind, the tide or water waves act to push a topside module against the support leg.

It should be noted that the topside module, the barge and/or the support legs of the support structure may be provided with shock-absorbing means, such as flexible fenders or mooring lines, in order to limit the impact of horizontal movement (i.e. horizontal with respect to the water level) between the topside module, barge and support structure and to limit deformation and damage of the topside module, barge and support structure caused by the action of water waves, water currents or the wind pushing the topside module and barge against the support structure for example.

According to a further embodiment of the invention the method comprises the step of moving the topside module and barge horizontally with respect to the water level. The topside module may for example be lifted along a side of at least one support leg of a support structure and then moved horizontally when it is in a position above the top of the at least one support leg. The topside module may then be lowered (by ballasting the barge again) so that it can be installed on top of the at least one support leg. It should however be noted that a topside module may be installed at any position on at least one support leg and need not necessarily be placed on top of at least one support leg.

According to an embodiment of the invention the method comprises the step of providing the topside module and/or offshore support structure with guide means to facilitate the movement of the topside module with respect to the at least one support leg. Guide means may for example be coated with, or comprise material having a low coefficient of friction, such as Teflon®.

According to an embodiment of the invention the method comprises the step lifting the topside module a height above water level in a step wise manner by repeatedly ballasting and de-ballasting said barge. The method step provides for a more controlled elevating of the topside module. The topside module can further be temporarily retained at a height above water level between ballasting and de-ballasting the barge. The topside module can be retained temporarily directly or indirectly to the support leg(s) for example. According to an embodiment of the invention, at least one spacer means can be arranged to the topside module, to carry the weight of the topside module. The spacer means can thus be temporarily retained to the support leg, permitting the barge to be de-ballasted. As a subsequent step, the barge can thereafter be temporarily attached to the spacer means whereafter the topside module can be lifted again by de-ballasting the barge. The topside module can thus be lifted in a stepwise manner and in a very controlled way. Generally no moving objects are needed to temporarily retain the topside module, directly or indirectly, to the support leg.

According to an embodiment of the invention the offshore supporting structure is a jacket structure. The topside module may comprise a renewable energy power plant, such as a wind, wave or under-water current power plant, an oil or gas platform and/or an offshore accommodation structure or any deck or equipment component of an offshore installation.

BRIEF DESCRIPTION OF THE DRAWINGS

The present invention will hereinafter be further explained by means of non-limiting examples with reference to the appended figures where.

It should be noted that the figures have not been drawn to scale and that the dimensions of certain features have been exaggerated for the sake of clarity.

DETAILED DESCRIPTION OF EMBODIMENTS

Figure 1:
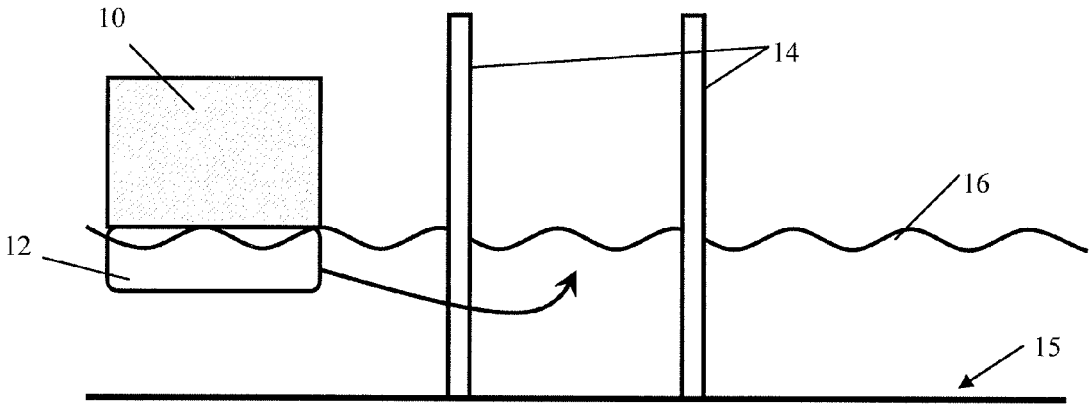
FIGS. 1-3 show a schematic representation of the steps of a method according to a first embodiment of the invention.
Figure 2:
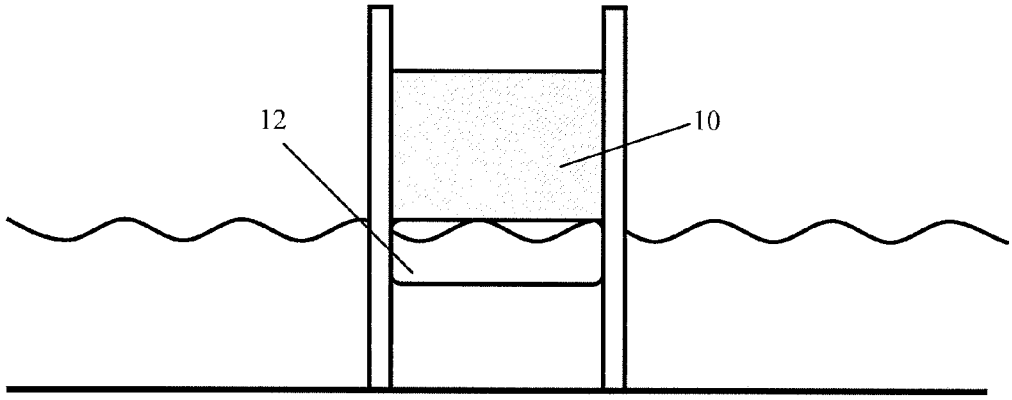
Figure 3:
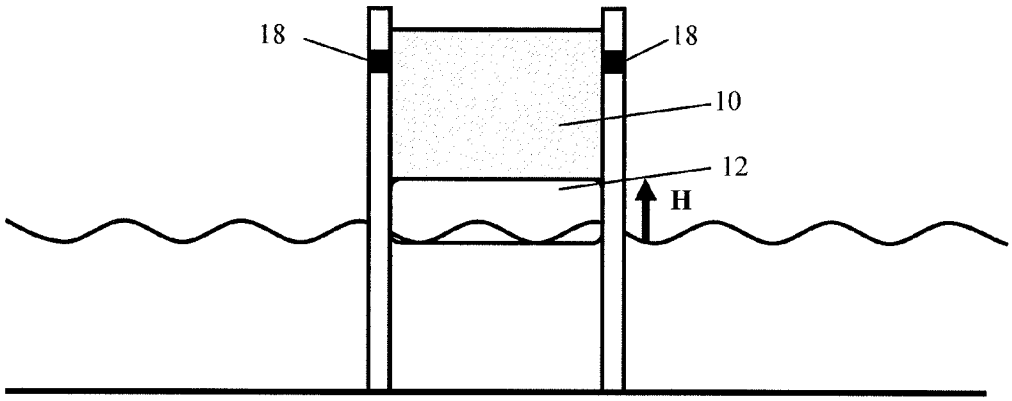
Figure 4:
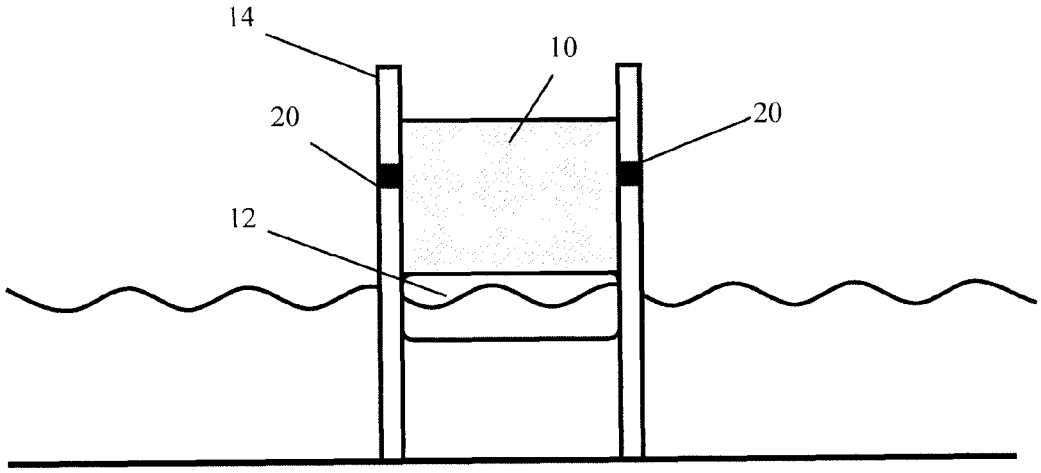
FIGS. 4-8 show a schematic representation of the steps of a method according to a second embodiment of the invention.

FIGS. 1-3 show a schematic representation of the steps of a method according to a first embodiment of the invention. A topside module 10 is supported on a floating de-ballastable barge 12 as shown from the side in FIG. 1. It should be noted that a topside module 10 need not necessarily be supported on the top surface of a barge 12 but it may be supported on equipment carried by the barge 12. Furthermore, a plurality of topside modules 10 may be lifted simultaneously using the method according to an embodiment of the present invention. The lifting of one or more topside modules 10 may furthermore be carried out in one or more steps. A single topside module may weigh up to 5000 tonnes, sometimes up to 10,000 tonnes or more.

The barge 12 is positioned between two or more support legs 14 of a support structure, such as a jacket structure that is driven into the sea bed 15. The support legs 14 may comprise concrete or metal and be of a cylindrical form and extend a height of 5-25 meters or more above the water level 16. The barge is positioned in a position adjacent to the support legs 14 whereby the outer surface of the topside module 10 and the outer sides of the barge 12 are adapted to be in contact with the inside surfaces of the support legs 14 in the illustrated embodiment shown from the side in FIG. 2.

The barge 12 is then de-ballasted in any conventional manner whereby the topside module 10 is lifted to a height H above water level 16. Purely by way of example, the barge may be de-ballasted by using ballast pumps which pump water out of ballast tanks (not shown) located within the barge 12. The topside module 10 is then fastened to the support legs 14, by welding for example, as represented by permanent fastening means 18 in FIG. 3. The barge 12 may then be moved away from the support structure or moved into a position to support and lift another topside module 10.

FIGS. 4-8 show a schematic representation of the steps of a method according to a second embodiment of the invention. In this embodiment a ballasted or non-ballasted floating barge 12 that supports a topside module 10 is positioned between a plurality of support legs 14 of a support structure, such as between six or eight support legs (only two of which are shown in the figures). The topside module 10 is temporarily anchored to the support legs 14 as represented by temporary anchoring points 20 in FIG. 4. The anchoring may prevent the topside module from moving vertically or from moving more than a predetermined vertical distance so that it will substantially stay in place as the barge 12 is submerged. The temporary anchoring means 20 may be projections on the support legs 14 on which parts of the topside module 10 are adapted to abut.

Figure 5:
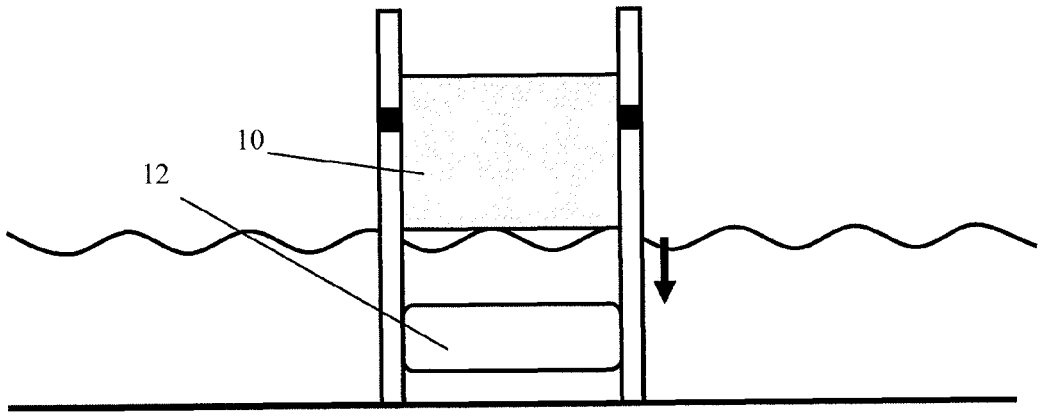

The barge 12 is then submerged as shown in FIG. 5 so that a vertical distance is created between the bottom of the topside module 10 and the top of the barge 12 as shown in FIG. 5.

Figure 6:
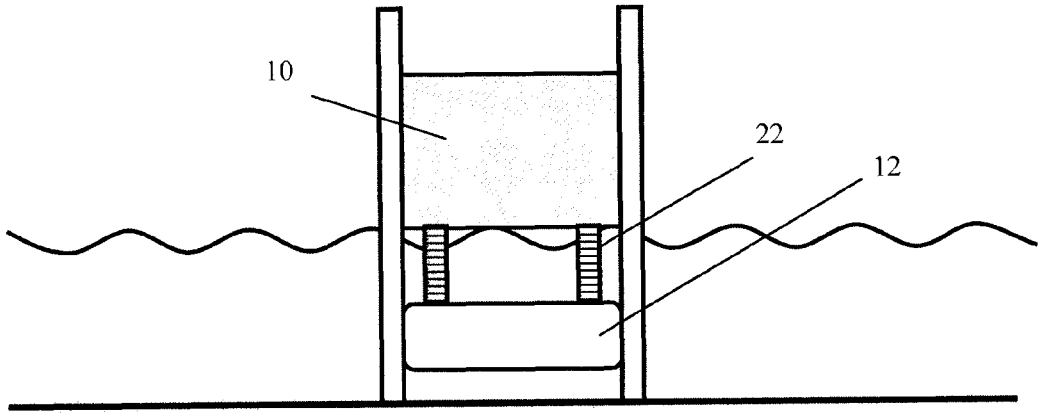

Spacer means 22, in the form of stanchions in the illustrated embodiment are then provided at least between the top of the submerged barge 12 and the bottom of the topside module 10 as shown in FIG. 6. The term "between" is not to be interpreted as that the spacer means 22 cannot extend along the side of the topside module 10. The temporary anchoring means 20 may be removed once the spacer means 22 have been locked in place. According to an embodiment of the invention the spacer means 22 may be arranged to be fixedly attached to the barge 12 and releasably attached to the topside module 10 (or vice versa) and are optionally provided (in a non-extended state) while the topside module 10 is being supported on the barge 12 before the barge is submerged, whereupon the spacer means 22 extend as the barge 12 is submerged and are locked in place when the barge 12 has been submerged a predetermined distance below water level 16.

According to an embodiment of the invention the spacer means 22 may be arranged to the barge 12 even before the barge 12 is ballasted, i.e. before the draught of the barge 12 is increased. The topside module is then arranged between at least two spacer means. As the draught of the barge 12 is increased, the spacer means extends at least between the barge 12 and the topside module 10. The spacer means 22 can thereafter be temporarily or permanently attached to the topside module 10.

Figure 7:
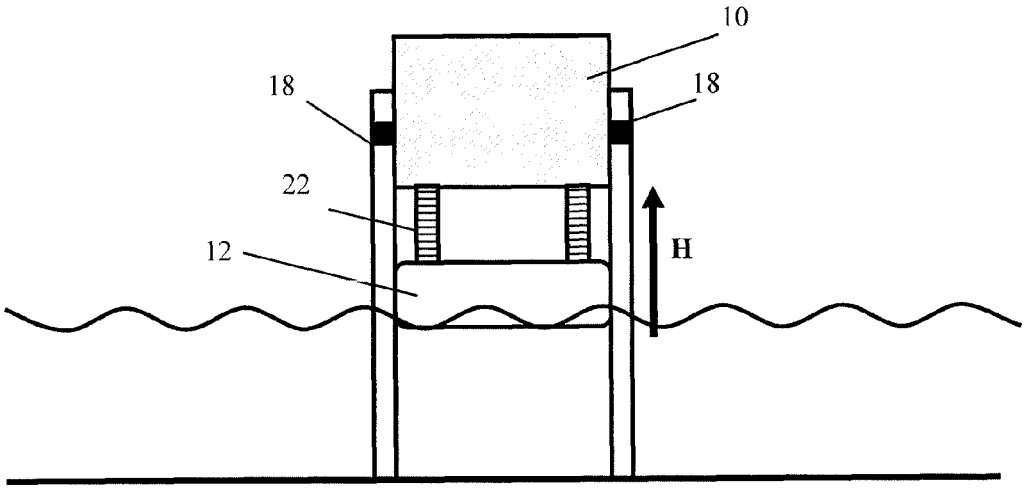

The barge 12 is then de-ballasted whereupon the topside module 10 and the spacer means 22 are lifted until the topside module 10 has been lifted to a height H above the water level 16 as shown in FIG. 7. The topside module 10 may then be permanently connected to the support legs, as represented by permanent connecting means 18. The spacer means 22 may then be disconnected or disabled from the topside module 10 and the barge 12 may be moved away from the support structure.

Figure 8:
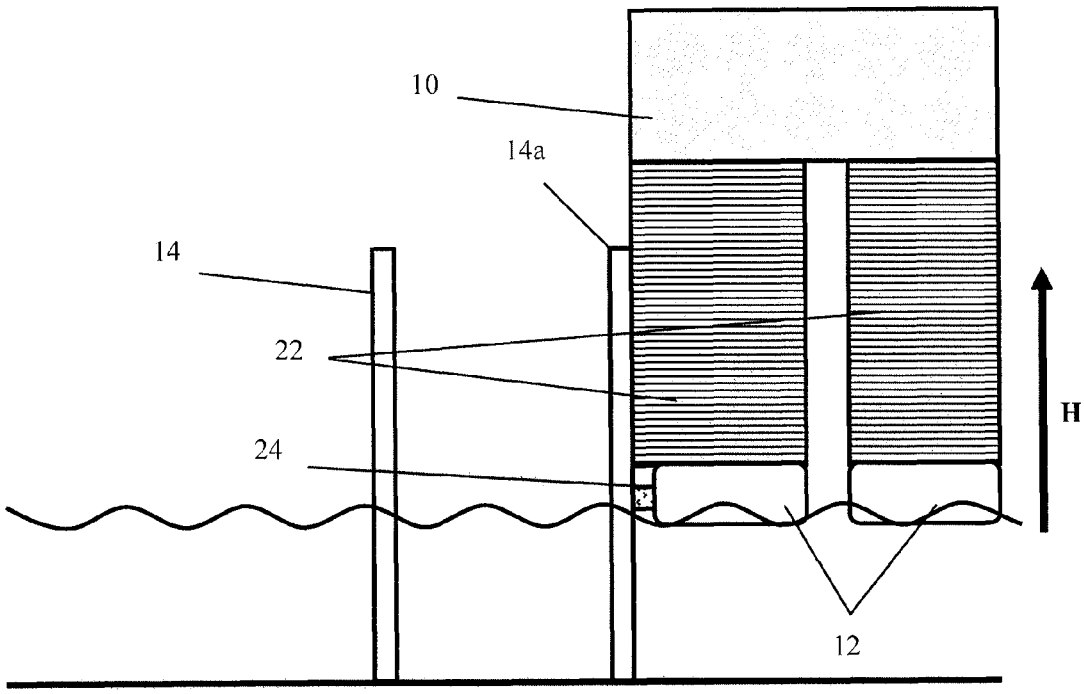

FIG. 8 shows a topside module 10 that has been placed on top of a plurality of support legs 14 by lifting the topside module 10 using a method according to the present invention and two barges 12. The right-hand outer side of the support leg shown on the right of FIG. 8 may be used to support the topside module 10 as it is lifted to a height above the top of the support legs 14 (for example by arranging the left-hand side of the topside module 10 and the left-hand side of the spacer means 22 of a first barge 12 to be in contact with the right-hand support leg 14). The topside module 10 may then be moved horizontally with respect to the water level over the top of the support legs 14 (for example by moving the barges 12 around the back of the support legs 14 and positioning the support leg 14*a* in between the two barges 12). The topside module 10 may then be lowered onto the top of the support legs 14 by ballasting the barges 12. Any number of barges 12 may of course be used to install a topside module 10 on a support structure.

According to an embodiment of the invention, a support structure may comprise an opening into which a topside module 10 may be guided after it has been lifted using a method according to the invention.

FIG. 8 also shows a barge 12 that has been provided with shock-absorbing means 24 that may be arranged to make contact with, and move within guide means (not shown) provided on the support legs 14.

Figure 9:
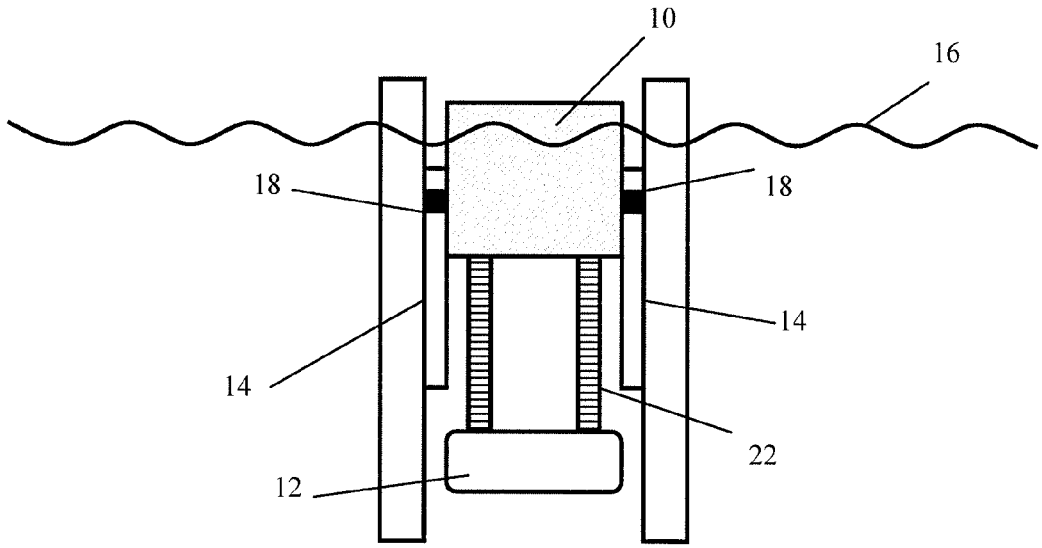
FIGS. 9-11 show a schematic representation of the steps of a method according to a third embodiment of the invention.
Figure 10:
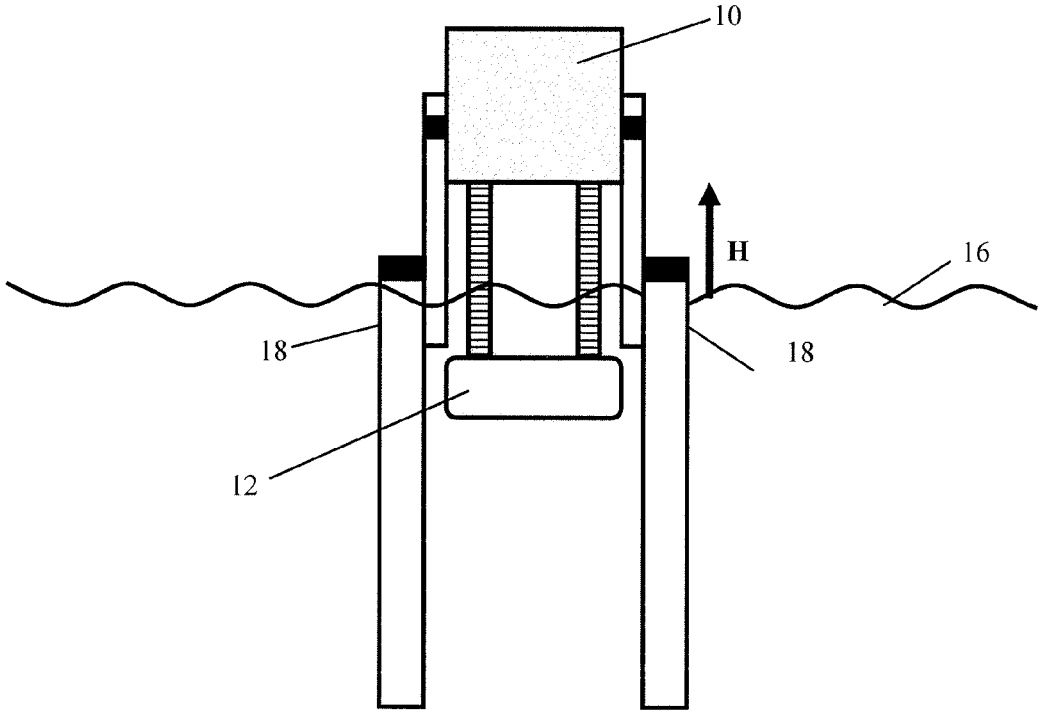

FIGS. 9-10 show a schematic representation of the steps of a method according to a third embodiment of the invention. In this embodiment a topside module 10 has been permanently attached (as represented at attachment points 18 in FIG. 9) to support legs that are, for example slidably attached to another part of a support structure and that are at least partially submerged under the water level 16 prior to lifting of the topside module 10. Once spacer means 22 have been provided between a submerged barge 12 and the topside module 10, the support legs 14, the topside module 10 and the spacer means 22 are lifted as the barge 12 is de-ballasted until the topside module has been lifted to a height H above the water level 16. The slidably movable support legs 14 may then be permanently locked in place. In FIGS. 9 and 10 the support structure is moored to the sea bed (not shown) or to some other structure. Such an embodiment allows installation work to be carried out at or near the water level 16.

It should be noted that, even when it has been lifted to a height H above the water level 16, a topside module 10 may comprise a component that is in contact with or submerged below the water level 16.

Figure 11:
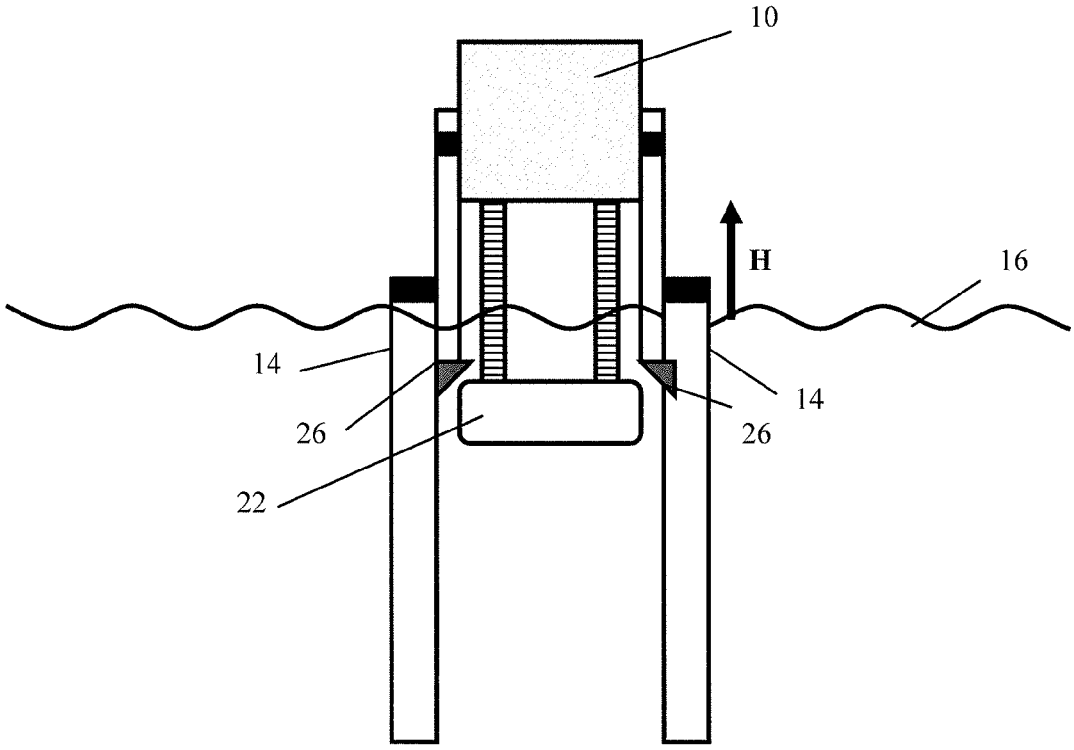

FIG. 11 shows that additional support means 26 may be provided to support the topside module 10 once it has been lifted to the desired height. The additional support means 26 may alternatively be in the form of one or more horizontal beam.

Figure 12A:
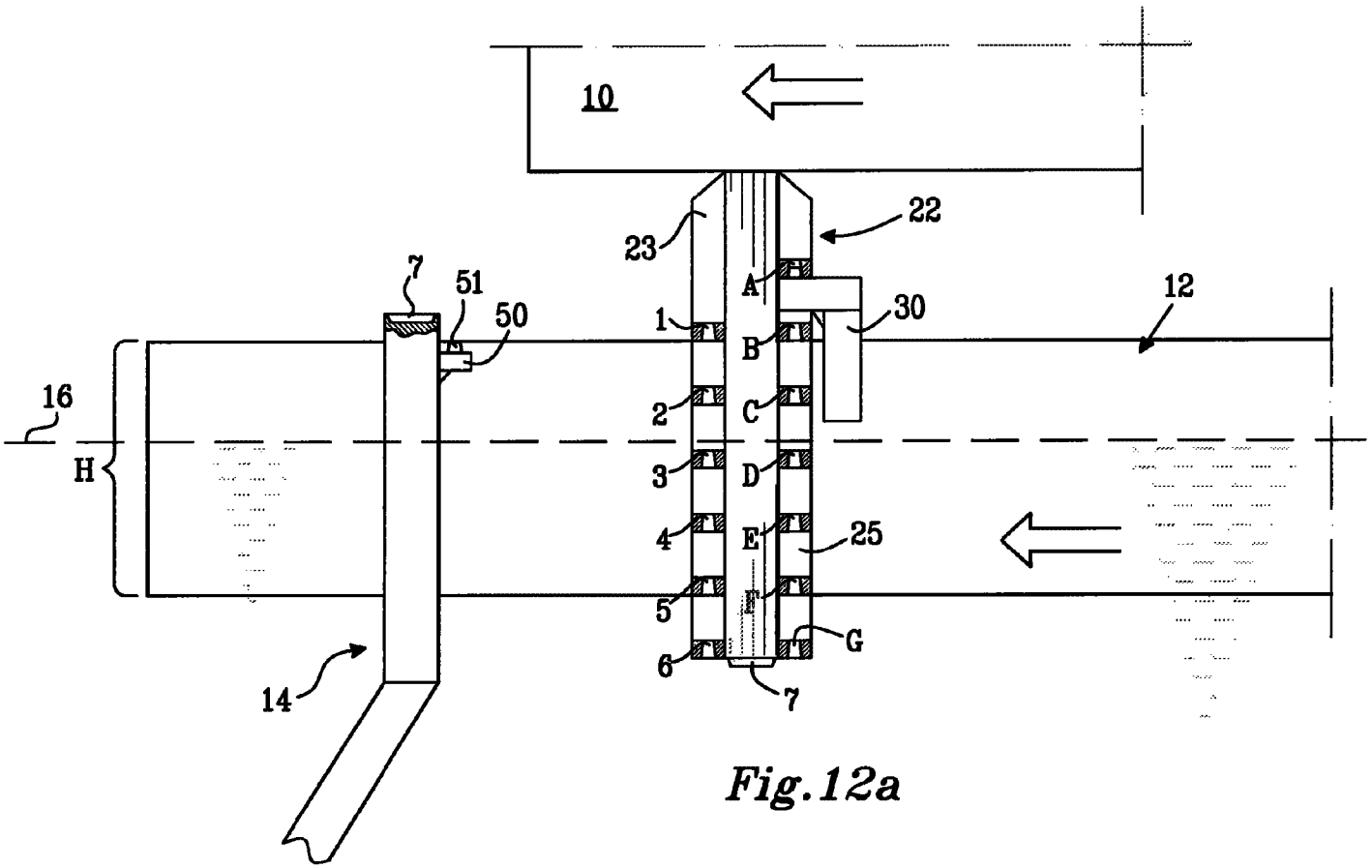
FIG. 12*a*-12*i* show a schematic representation of the steps of a method according to a fourth embodiment of the invention, illustrating how the topside module can be lifted in a stepwise manner by ballasting and de-ballasting the barge.

With reference to FIGS. 12*a*-12*i*, a method for installing a topside module according to a fourth embodiment of the present invention will be described in greater detail. The method comprises at least one method step in which the topside module is lifted in a step wise manner. FIG. 12*a* shows a barge 12 arranged to spacer means 22 onto which the topside module 12 is arranged. A support leg 14 standing of the ocean floor (not shown), in this embodiment a part of a jacket, is further shown. The support leg 14 comprises a support flange 50 fixedly mounted to the support leg 14. The support flange 50 is further arranged with a cone shaped protrusion 51 arranged to be in working cooperation with a cone shaped groove of the spacer means 22. The support leg 14 and barge 12 can therefore be said to comprise engagement means for temporarily engage and retain the spacer means 22. The barge 12 is partly submersed below the water level 16.

The spacer means 22 comprises at least a first and an opposing second side 23, 25 each arranged with cone shaped grooves 1-6, A-G, respectively. The cone shaped grooves 1-6 on the first side 23 of the spacer means 22 are arranged to temporarily engage the support flange 50 of the support leg 14. Likewise, the cone shaped grooves A-G on the second side 25 of the spacer means 22 are arranged to temporarily engage the barge 12 in a manner which will be outlined below.

Figure 12B:
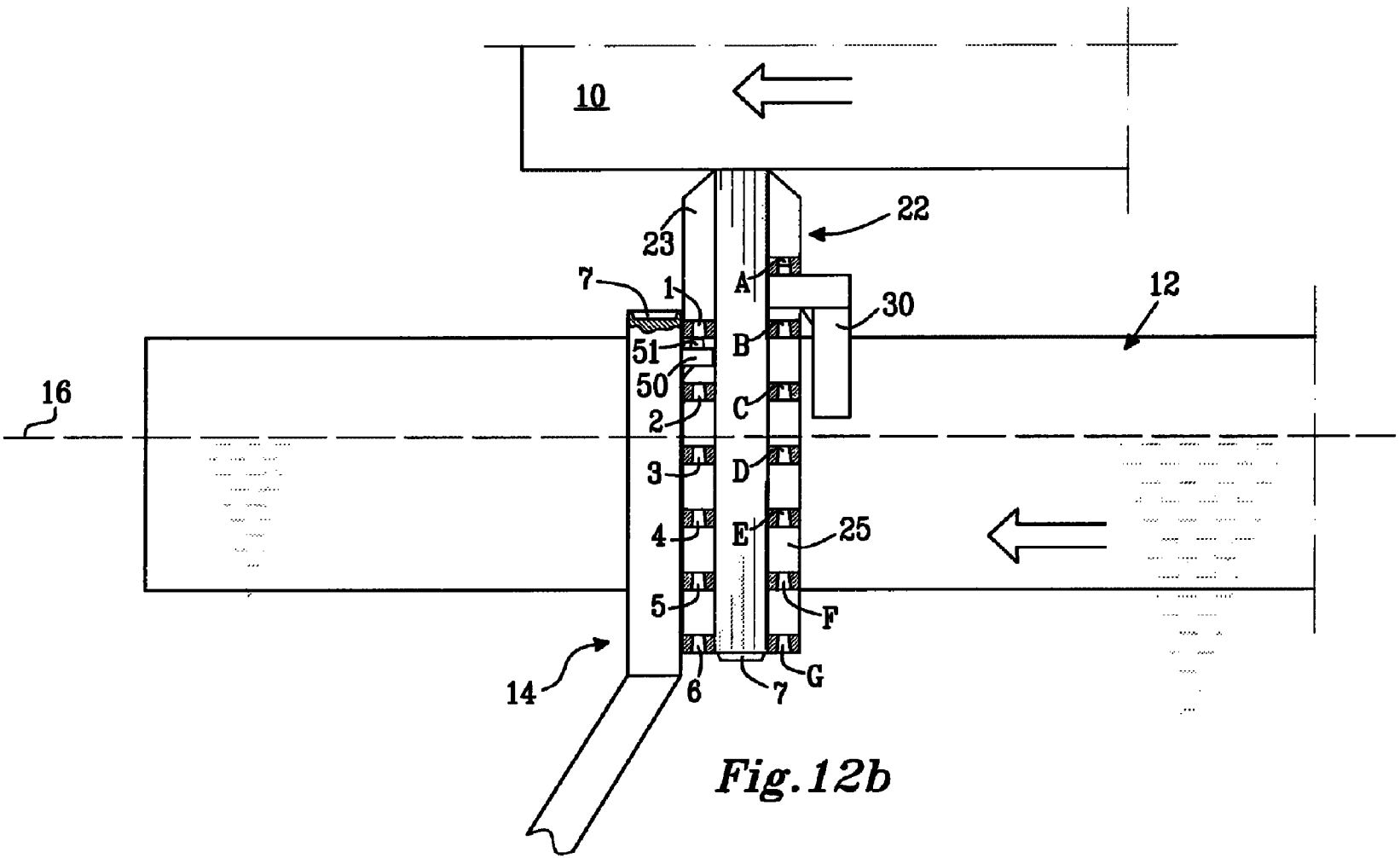
Figure 12C:
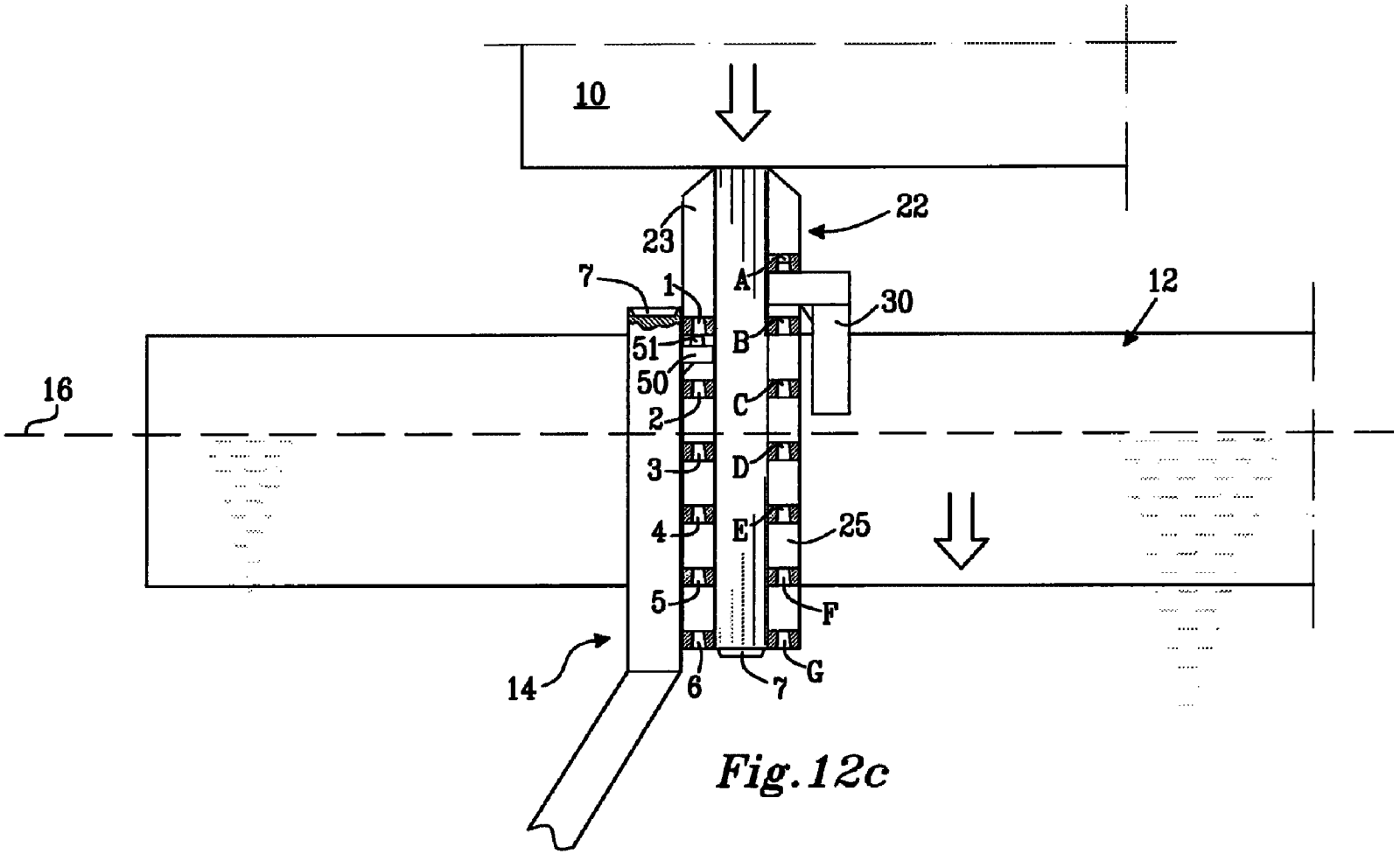
Figure 12D:
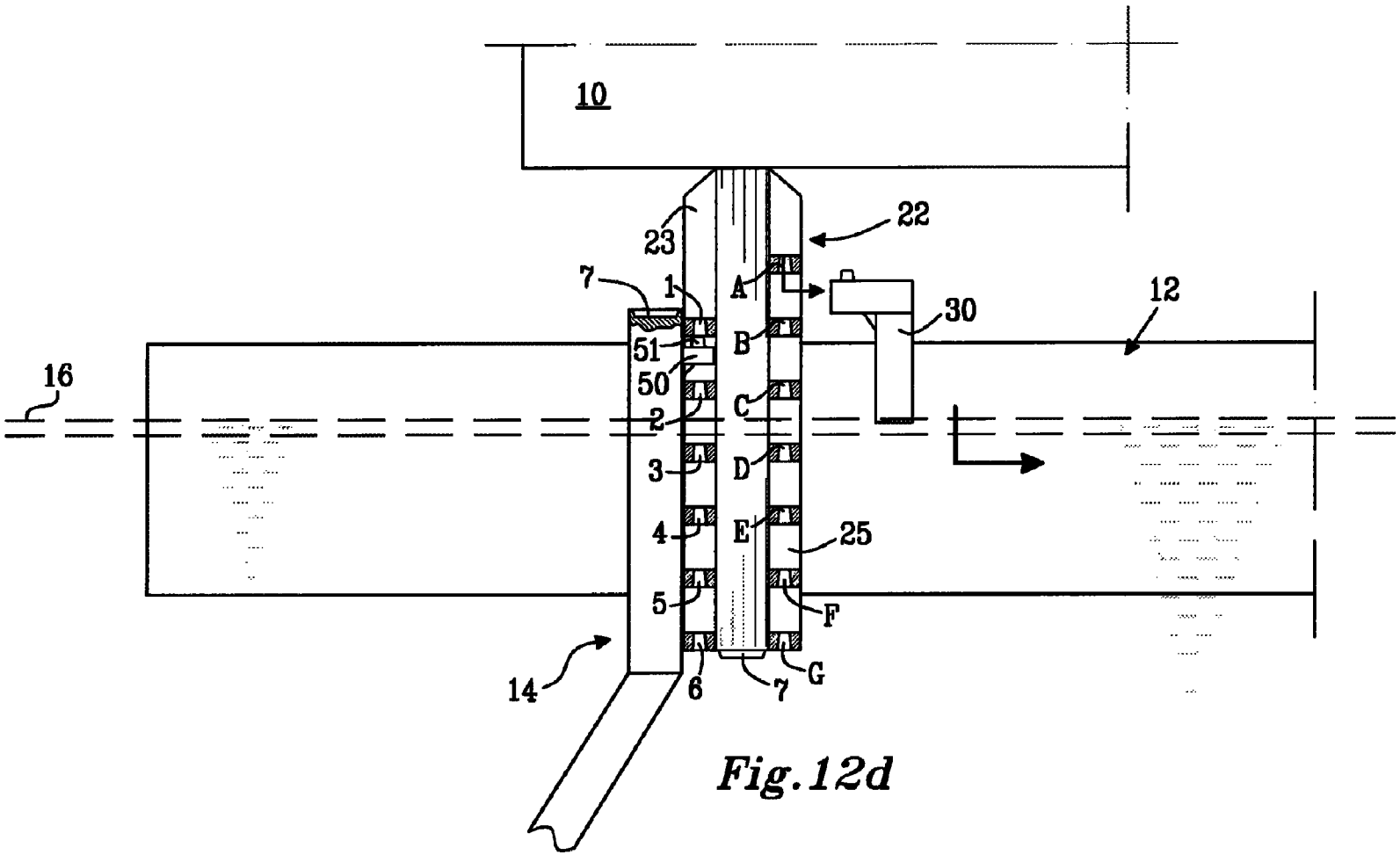
Figure 12E:
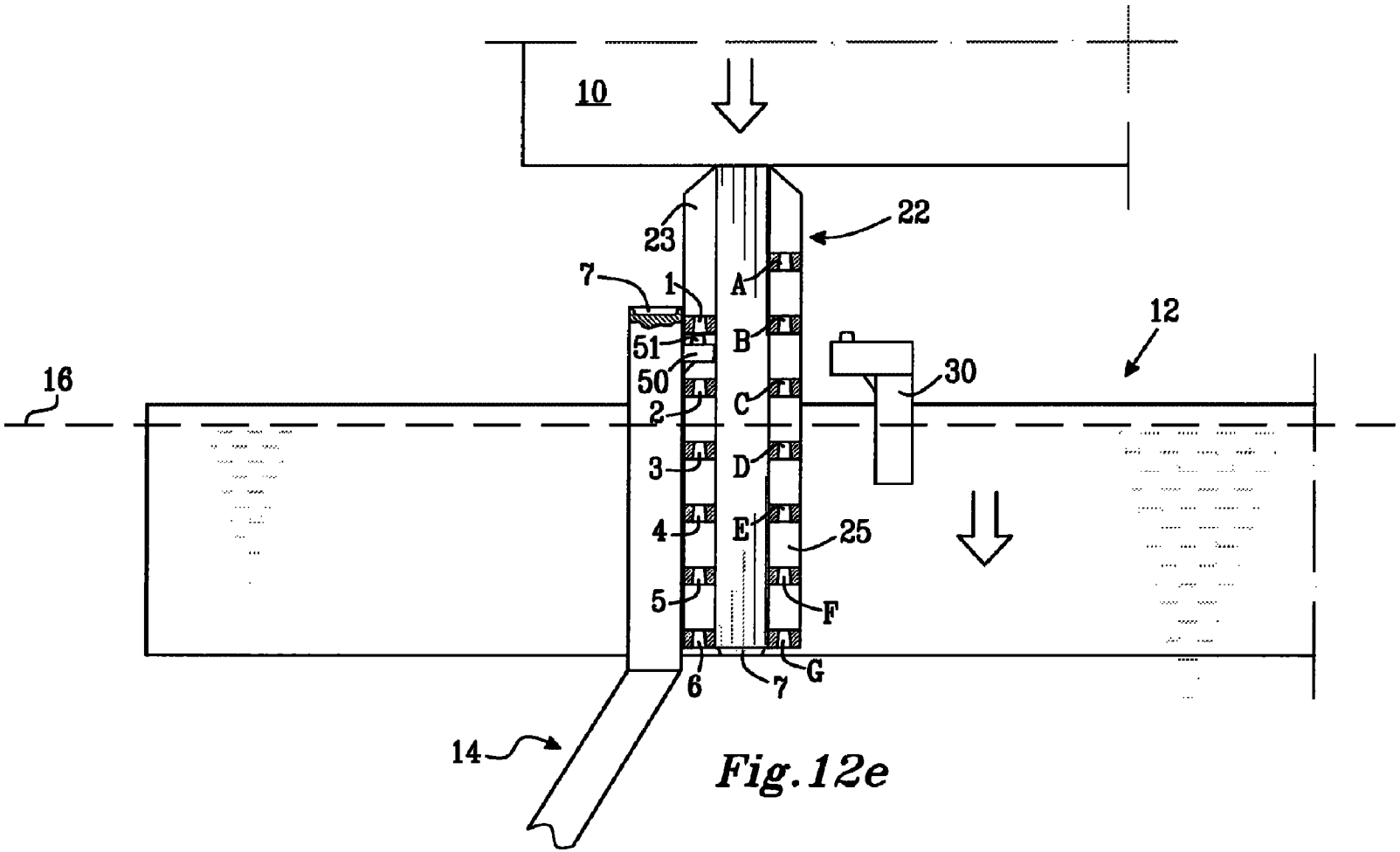

FIG. 12*a* shows the topside module 10 being arranged on the spacer means 22, which in turn is arranged to the barge 12 via a spacer means carrier portion 30. The barge 12 and the spacer means 22 is brought forward, in a direction as indicated with the arrow, towards the support leg 14. As is noticed, the water lever 16 is at a level of about 60% of the height H of the barge 12. The cone shaped groove 1 of the first side 23 of the spacer means 22 is thereafter brought to engage with the support flange 50 and the cone shaped protrusion 51, as shown in FIG. 12*b*-12*c*. FIG. 12 *c* shows how the barge 12 is de-ballasted to lower the spacer means 22 and to engage the support flange 50 with the cone shaped groove 1 of the first side 23 of the spacer means 22. As the barge 12 is de-ballasted, the cone shaped groove A of the second side 25 disengages the spacer means carrier portion 30 as shown in FIG. 12*d*. The barge 12 can thereafter be brought back, away from the support leg 14, as indicated by the arrow in FIG. 12*d*.

FIG. 12*d* shows how the spacer means 22 rests on the support flange 50 of the support leg 14. The barge 12 has been disengaged and removed from the spacer means 22 by an appropriate distance. In the following step, the barge 12 is ballasted, submersing the barge 12 in the water and moving the barge in a direction as indicated by the arrow in FIG. 12*e*. As the barge 12 is submersed, the spacer means carrier portion 30 of the barge 12 is substantially leveled to an appropriate position to engage a cone shaped groove B, on the second side 25 of the spacer means 22. The cone shaped groove B, being at a distance from the cone shaped groove A of about 4-5 meters and further away from the topside module 10 as compared with cone shaped groove A.

Figure 12F:
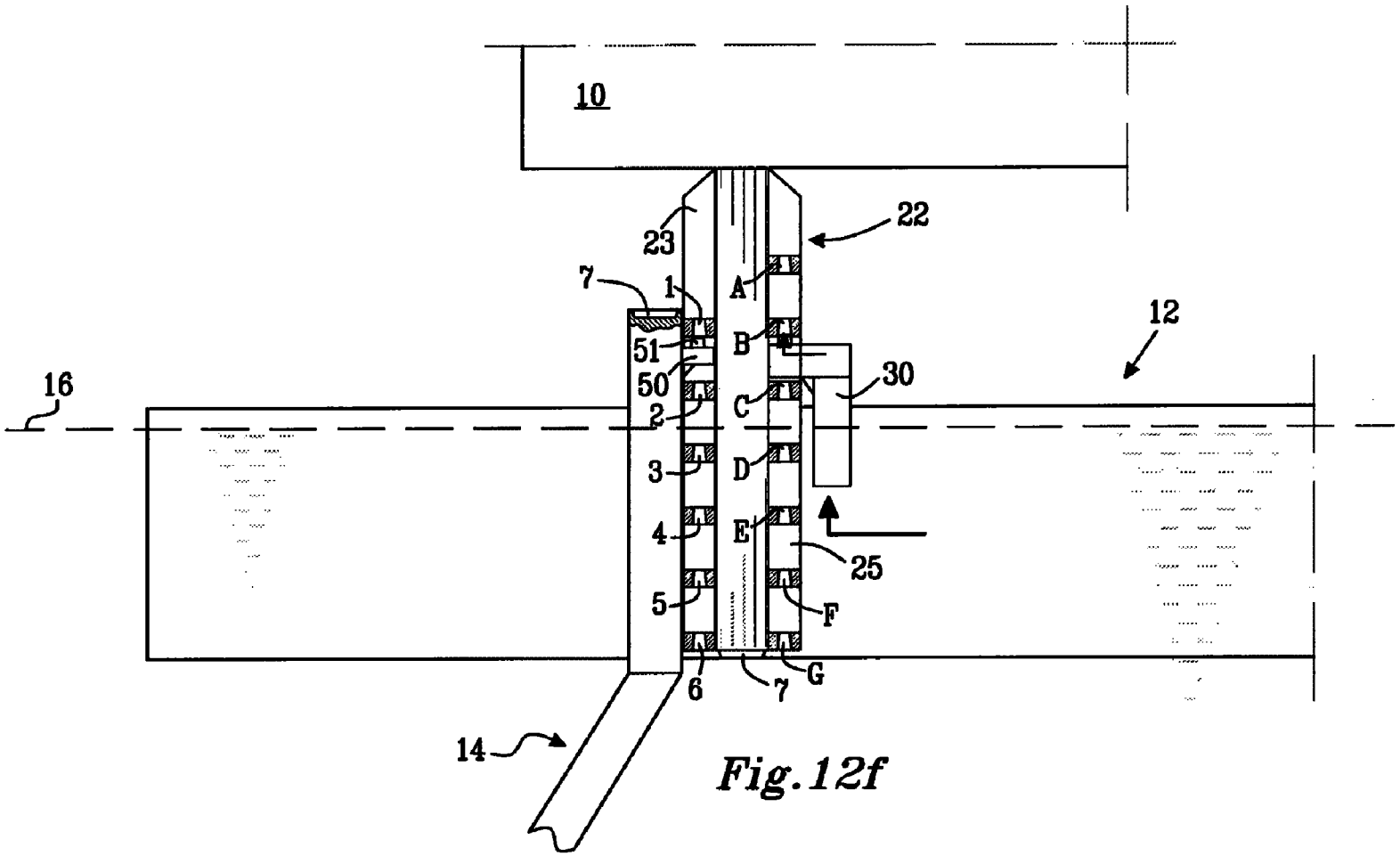
Figure 12G:
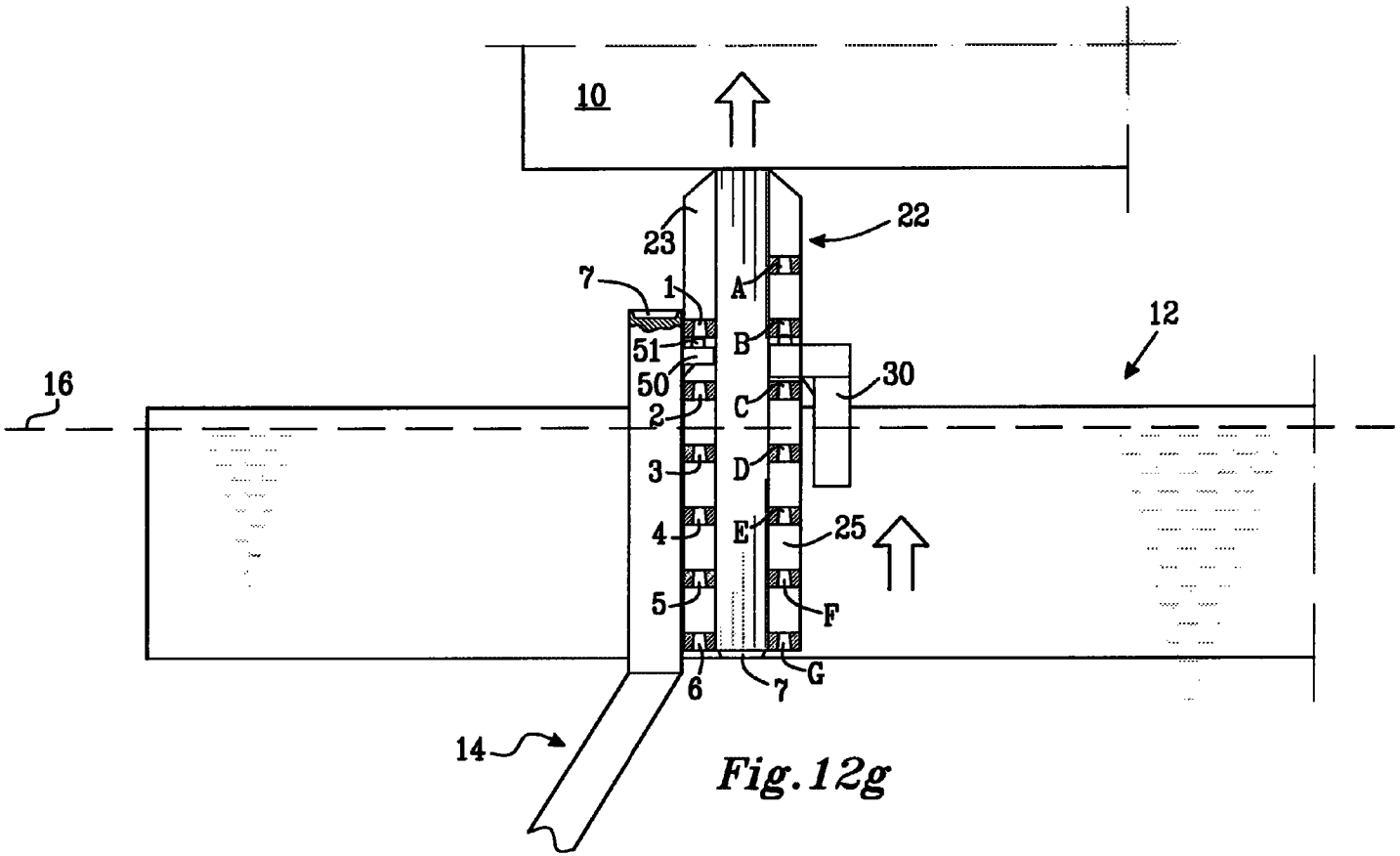

The barge 12 is again brought forward towards the support leg 14, as partly indicated by the arrow in FIG. 12*f* and the spacer carrier portion 30 is brought into engagement with the cone shaped groove B on the second side 25 of the spacer means 22. The spacer means 22 is subsequently lifted again by de-ballasting the barge 12 and the support flange 50 disengages the cone shaped groove 1 on the first side 23 of the spacer means 22. The weight of the top module 10 is at this point carried by the spacer carrier portion 30. Again, as mentioned above, the number of support legs 14 and the spacer means 22 can vary, e.g. 4-8 support legs 14 and 4-8 spacer means 22 can be used.

Figure 12H:
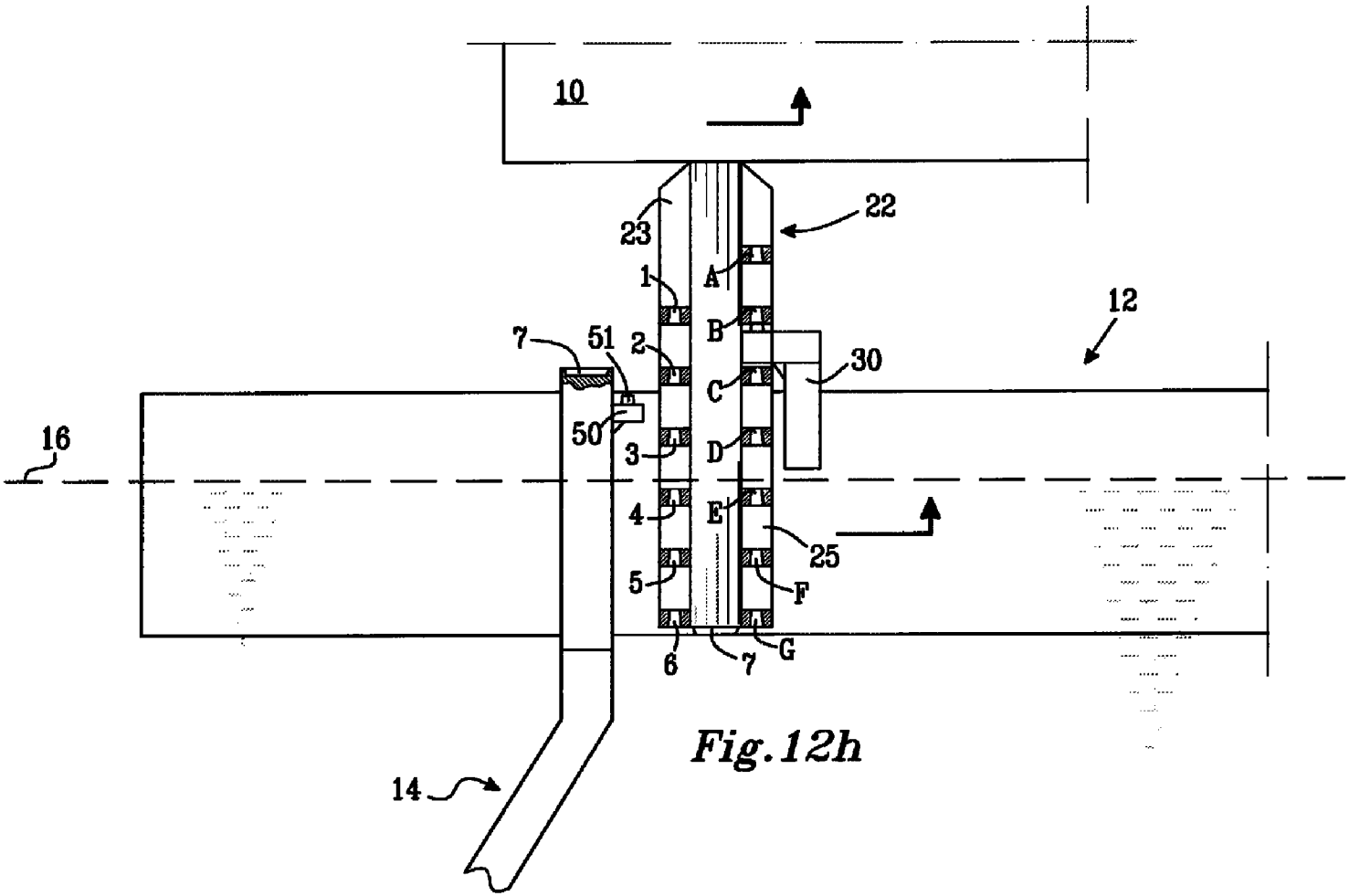

In FIG. 12*h*, the barge 12 has been moved away from the support leg 14 and has been de-ballasted, as indicated by the water level 16. As a consequence, the top module 10 is raised another level of approximately 4-5 meters.

Figure 12I:
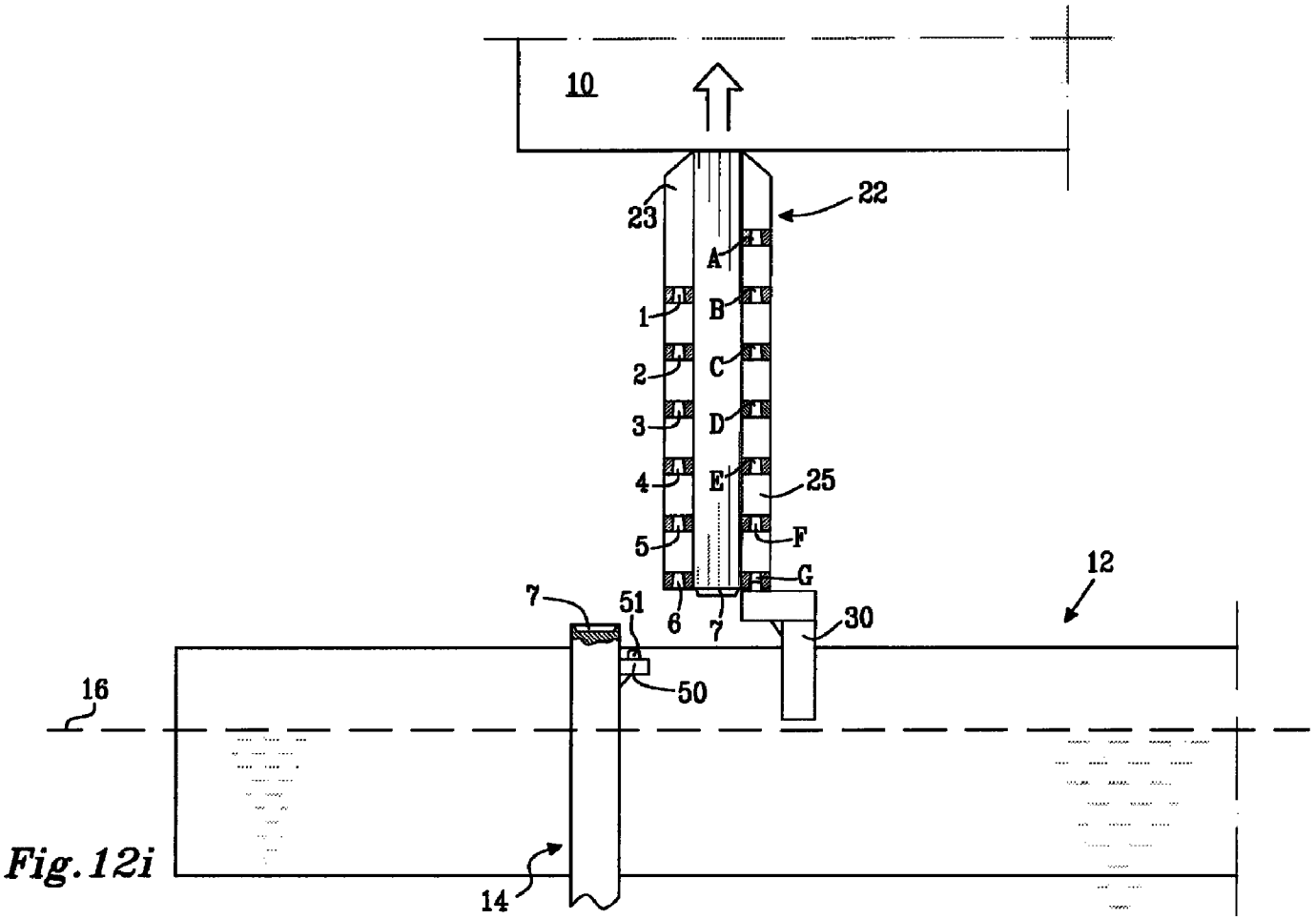

The procedure as outlined in FIG. 12*a*-12*h* are repeated until the spacer means 22 can be arranged on a spacer means receiving means 7 on the support leg 14 and the spacer means 22, as shown in FIG. 12*i*. The spacer means 22 can be thereafter be permanently attached to the support leg 14, e.g. by welding, if necessary.

Further modifications of the invention would be apparent to a skilled person. For example, the method according to the present invention need not necessarily only be used during the assembly or modification of an offshore installation. It may be used to raise and/or lower equipment, such as machinery or a boat to and/or from the deck of an offshore installation, or to raise and/or lower workmen and their materials to enable them to carry out work on some part of an offshore installation, such as painting the support legs of a support structure with corrosion resistant paint.

The invention claimed is:

1. A method for installing a topside module on an offshore support structure located in a body of water having a water level, said offshore support structure comprising a plurality of support legs, wherein the method comprises:

supporting said topside module on a barge in a position adjacent to at least one of said support legs;

de-ballasting the barge to lift the topside module a height above water level; and arranging said topside module to said at least one support leg, said method comprises the step of supporting said topside module on a barge in a position adjacent and between at least two of said plurality of support legs, and wherein said plurality of support legs comprises at least three support legs, and in that said topside module supported on said barge is moved in a first direction between said at least two support legs, and in that a third support leg is positioned to obstruct at least said barge from movement in said first direction.

2. The method according to claim 1, wherein said offshore structure comprises at least four support legs, and in that said topside module supported on said barge is moved in a first direction between said at least two support legs, and in that a third and fourth support leg is positioned to obstruct at least said barge from movement in said first direction.

* * * * *